United States Patent [19]

Trestyn

[11] Patent Number: 4,809,940

[45] Date of Patent: Mar. 7, 1989

[54] BRACKET FOR PERFORATED WALLS

[75] Inventor: Cary Trestyn, Port Washington, N.Y.

[73] Assignee: Ultimate Plastics, Inc., Jamaica, N.Y.

[21] Appl. No.: 129,800

[22] Filed: Dec. 7, 1987

[51] Int. Cl.[4] ..... A47F 5/00

[52] U.S. Cl. ..... 248/220.4; 248/222.2; 211/187

[58] Field of Search ..... 248/544, 220.3, 220.4, 248/221.1, 221.2, 222.3, 225.2; 211/87, 57.1, 59.1, 54.1, 187, 208

[56] References Cited

U.S. PATENT DOCUMENTS

| | | | |
|---|---|---|---|
| 2,534,952 | 12/1950 | Comer | 248/221.2 X |
| 3,211,408 | 10/1965 | Schaefer | 248/220.4 |
| 4,062,137 | 12/1977 | Herzog | 248/220.3 X |
| 4,066,169 | 1/1978 | Hochman | 248/220.3 X |
| 4,351,440 | 9/1982 | Thalenfeld | 248/220.4 |
| 4,463,510 | 8/1984 | Windish | 248/220.4 |
| 4,474,351 | 10/1984 | Thalenfeld | 248/222.2 |
| 4,502,602 | 3/1985 | Swanson | 248/220.4 X |
| 4,678,151 | 7/1987 | Radek | 211/59.1 |

FOREIGN PATENT DOCUMENTS

| | | | |
|---|---|---|---|
| 2719896 | 11/1978 | Fed. Rep. of Germany | 248/221.1 |
| 708989 | 5/1954 | United Kingdom | 248/220.4 |
| 792253 | 3/1958 | United Kingdom | 248/220.4 |

*Primary Examiner*—J. Franklin Foss
*Assistant Examiner*—Robert A. Olson
*Attorney, Agent, or Firm*—Kenyon & Kenyon

[57] ABSTRACT

A bracket adapted to be secured to a perforated wall comprising a first member extending generally in a first direction, a second pivotal member disposed on the first member having an L-shaped section having two legs, the pivotal member having two positions, in a first position, a first of the two legs arranged farthest from the pivotal member being disposed generally horizontally for insertion into a perforation of the wall, and in a second position, the first of the two legs being disposed generally vertically after the first leg has been inserted into a perforation in the wall for securing the first member to the wall by the influence of a gravity, whereby the first member extends outwardly from the wall in the first direction.

5 Claims, 2 Drawing Sheets

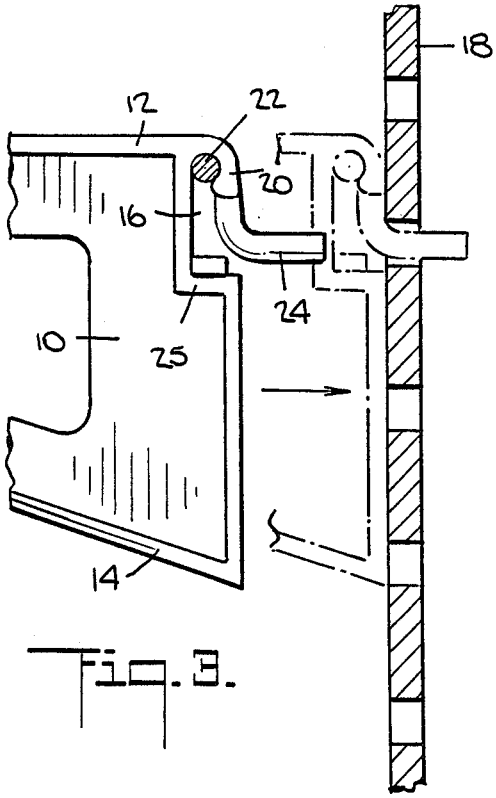
Fig. 3.
Fig. 4.
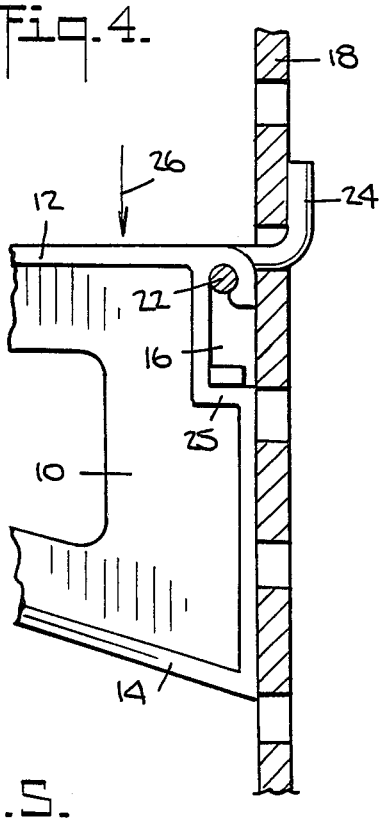
Fig. 5.
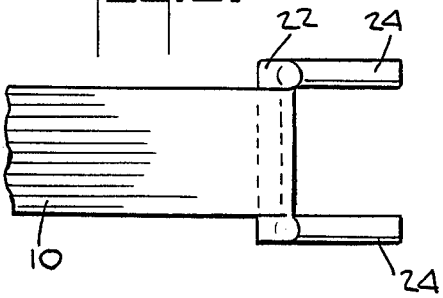
Fig. 7.
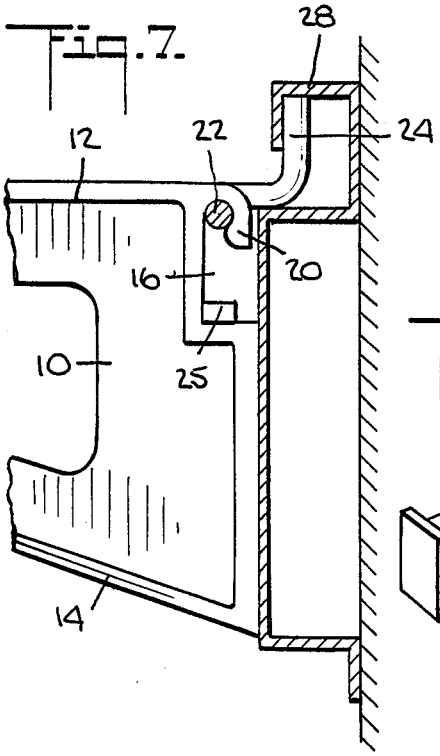
Fig. 6.
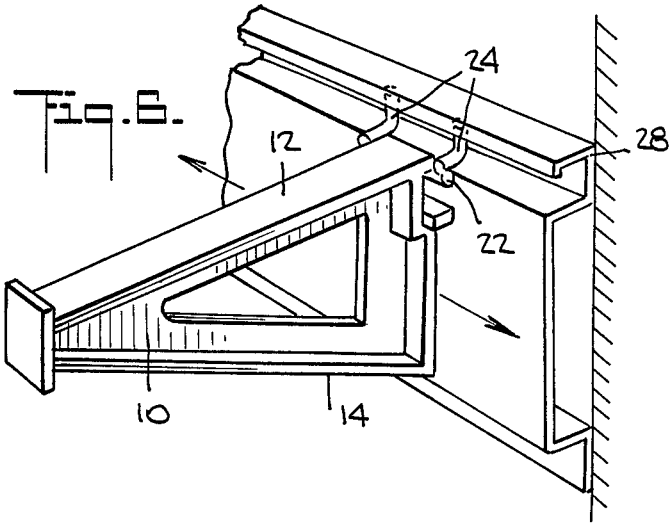

BRACKET FOR PERFORATED WALLS

BACKGROUND OF THE INVENTION

The present invention relates to wall and shelf brackets, and in particular, to a bracket for suspending shelves or articles from walls having perforations therein. In particular, the present invention applies to brackets for such walls, for example, made of pegboard or having slotted areas.

Various types of brackets for pegboard walls or slotted walls are known. In these type brackets, an extension of the bracket which has a vertically disposed end, is placed into the perforation or slot in the wall material receiving the bracket. In order to place the bracket into the pegboard material or slot, however, the bracket must be rotated by approximately 90° so that the vertically disposed ends of the pegboard bracket are disposed approximately horizontally. The now horizontally disposed ends of the bracket can then be inserted into the holes in the wall or the slot. In order to secure the bracket to the wall, the bracket is then rotated back to its horizontal position, thus allowing the ends of the bracket to be vertically disposed, thus securing the bracket to the wall by the action of gravity, i.e., the vertically disposed bracket ends act to secure the bracket to the wall.

The problem with these type of brackets arises from the fact that if the bracket is placed on a shelf where other brackets are disposed above that bracket, the attachment of the bracket to the wall will interfere with those brackets or items which are hanging from those brackets, since the approximately 90° of rotation required to insert the bracket into the perforations or slots in the wall will cause the bracket to come into contact with those brackets disposed above during the insertion process.

Furthermore, the brackets of the known type are often difficult to insert into the perforations or slots in the wall because of the rotational movements required to attach the bracket to the wall.

Examples of prior art arrangements are shown in U.S. Pat. Nos. 2,534,952, 4,062,137, 4,066,169 and 4,502,602.

SUMMARY OF THE INVENTION

It is an object of the present invention to provide a wall bracket for perforated or slotted walls wherein the above mentioned disadvantages are eliminated.

It is furthermore an object of the present invention to provide such a wall bracket which allows horizontal entry of the brakcet into the wall.

It is yet still another object of the present invention to provide such a bracket which eliminates any rotational movements required in inserting the bracket into the wall.

It is yet still a further object of the invention to provide such a bracket which allows insertion into a perforated or slotted wall without interfering with other brackets disposed above the bracket inserted.

Other objects and advantages of the present invention will be apparent from the detailed description which follows.

BRIEF DESCRIPTION OF THE DRAWINGS

The invention will be explained in greater detail in the following detailed description with reference to the drawings in which:

FIG. 3 is a detailed cross-sectional view showing the bracket according to the present invention being installed onto a perforated wall;

FIG. 4 shows a bracket according to the present invention after installation onto a perforated wall;

FIG. 5 shows a top view of a portion of the bracket according to the present invention;

FIG. 6 shows the bracket according to the present invention installed on a slotted wall; and FIG. 7 is a cross-sectional view showing the bracket of the present invention installed on a slotted wall.

DETAILED DESCRIPTION

Figure 1:
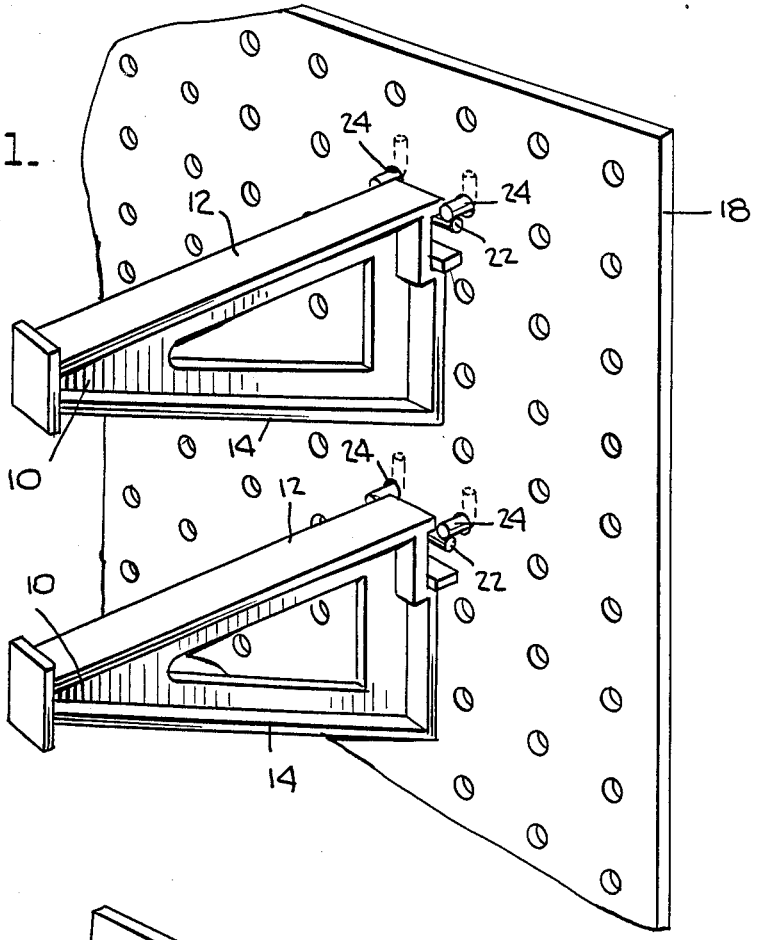
FIG. 1 shows two brackets according to the present invention installed in vertical alignment on a perforated wall.

With reference now to the drawings, the bracket according to the present invention is designated with 10 in the figures and two of such brackets are shown in FIG. 1. As shown, the bracket may comprise a horizontally extending section 12 which is suitable for holding a shelf or for suspending an object to be stored or displayed. The exemplary bracket shown comprises a triangular shaped member, but the bracket may have other shapes, for example, it may be simply a horizontally extending section without the lower portion 14 shown, if less strength is necessary. The bracket may be made of plastic or metal. The bracket may be made of other materials, as suitable to meet the particular requirements. As shown in the figures, the bracket includes a recess 16 at the end abutting the wall 18, which may be a pegboard type wall as shown in FIGS. 1–4 or a slotted type wall as shown in FIGS. 6 and 7. The recess portion 16 includes a vertically disposed portion 20 into which a shaft portion 22 is received via a snap fit. The shaft 22 is provided with two L-shaped members 24 which are preferably disposed so that when the bracket is not attached to the wall 18, they assume the position shown in FIG. 2 and FIG. 3, i.e., the ends of the L-shaped members farthest from the shaft 22 are disposed approximately horizontally and the legs of the L-shaped members which are attached to the shaft 22 are disposed approximately vertically.

Figure 2:
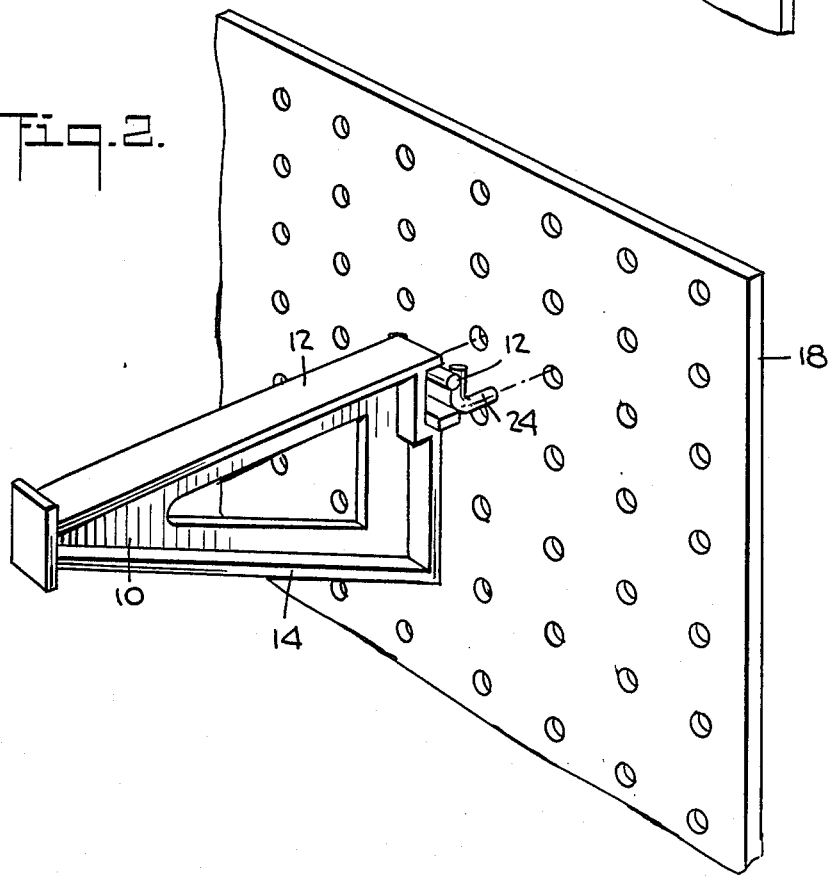
FIG. 2 shows a bracket of the present invention prior to insertion into the perforated wall.

In order to install the bracket, the L-shaped members are disposed so that they assume the position in FIG. 2. Preferably, the fit of shaft 22 into the recess 16 is provided so that the L-shaped members 24 fall freely by the action of gravity into the position shown in FIGS. 2 and 3, but this is not required. In order to insert the bracket into the wall 18, the ends of the L-shaped member 24 are simply inserted horizontally into the perforations or slots in the wall 18, and then the bracket is allowed to fall by the action of gravity, as shown by the arrow 26 in FIG. 4. The ends of the L-shaped bracket 24 farthest from the shaft 22 then assume the position shown in FIG. 4, securely holding the bracket to the wall by the influence of the force of gravity.

A stop member 25 may be provided as shown in recess 16 in order to limit the rotational movement of L-shaped member 24.

As shown in FIGS. 6 and 7, the wall may be a slotted type wall such as that shown at 28, wherein an extruded member is securely fastened to a wall to form a slot or series of slots in the wall. This allows the bracket 10 to be moved to any position horizontally along the wall, thus allowing greater versatility than the conventional pegboard type wall shown in FIGS. 1 through 5.

Shaft 22 and member 24 may be made integral or as separate members suitably fastened together. Additionally, shaft 22 may be made in two unconnected parts, one part coupled to respective members 24.

In the foregoing specification, the invention has been described with reference to exemplary embodiments thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. A bracket adapted to be secured to a perforated wall comprising:

a first member extending generally in a first direction;

a second pivotal member comprising a shaft pivotally disposed on said first member and having two L-shaped sections each having two legs coupled to said shaft on opposite ends of said shaft, said L-shaped sections each forming an angle of substantially 90° between said two legs, said pivotal member having two positions, in a first position, a first of said two legs of each L-shaped section arranged farthest from said shaft being dispsoed generally horizontally for insertion into a perforation of the wall, and in a second position, said first of said two legs of each L-shaped section being dispsoed generally vertically after said first legs have been inserted into a perforation in the wall for securing said first member to the wall by the influence of gravity, whereby said first member extends outwardly from the wall in the first direction, said first member extending in an outward direction and including a recess opening perpendicularly to said outward direction for receiving said shaft of said pivotal member, said recess comprising a slot providing a snap fit of said shaft into said recess.

2. The bracket recited in claim 1, wherein said first member is triangular in shape.

3. The bracket recited in claim 1, wherein said first and second members are made of at least one of metal and plastic.

4. The bracket recited in claim 1, wherein said second pivotal member and said L-shaped sections are integral.

5. The bracket recited in claim 1, wherein said L-shaped sections are secured to said pivotal member with fastening means.

* * * * *